United States Patent [19]

Abe et al.

[11] Patent Number: 4,698,765

[45] Date of Patent: Oct. 6, 1987

[54] IGNITION TIMING CONTROL SYSTEM FOR AN AUTOMOTIVE ENGINE

[75] Inventors: Kunihiro Abe, Higashimurayama; Yoshitake Matsumura, Hachiouji; Takurou Morozumi, Mitaka, all of Japan

[73] Assignee: Fuji Jukogyo Kabushiki Kaisha, Tokyo, Japan

[21] Appl. No.: 757,816

[22] Filed: Jul. 22, 1985

[30] Foreign Application Priority Data

Jul. 27, 1984 [JP] Japan ..... 59-158030

[51] Int. Cl.[4] ..... F02P 5/14

[52] U.S. Cl. ..... 364/431.04; 123/489

[58] Field of Search ..... 364/431.04, 431.05, 364/431.12; 123/486, 480, 417, 489

[56] References Cited

U.S. PATENT DOCUMENTS

| | | | |
|---|---|---|---|
| 4,376,428 | 3/1983 | Hata et al. | 364/431.04 |
| 4,377,996 | 3/1983 | Yamaguchi | 123/417 |
| 4,461,261 | 7/1984 | Isomura et al. | 123/489 |
| 4,508,075 | 4/1985 | Takao et al. | 123/489 |
| 4,510,910 | 4/1985 | Ninomiya et al. | 123/486 |
| 4,644,920 | 2/1987 | Abe et al. | 123/486 |

*Primary Examiner*—Parshotam S. Lall

*Attorney, Agent, or Firm*—Martin A. Farber

[57] ABSTRACT

A system is provided for updating data stored in a table at a steady state of an engine in accordance with a feedback signal of an $O_2$-sensor. When an updated data is exceeds a predetermined upper or lower limit value, the ignition timing of the engine is adjusted.

2 Claims, 11 Drawing Figures

IGNITION TIMING CONTROL SYSTEM FOR AN AUTOMOTIVE ENGINE

BACKGROUND OF THE INVENTION

The present invention relates to a system for controlling the ignition timing of an automotive engine at the failure of a sensor, and more particularly to an ignition timing control system using a learning control system which is provided for updating data stored in a table for controlling the fuel supply in an electronic fuel-injection system.

In one type of electronic fuel-injection control, the amount of fuel to be injected into the engine is determined in accordance with engine operating variables such as mass air flow, engine speed and engine load. The amount of fuel is decided by a fuel injector energization time (injection pulse width). Basic injection pulse width ($T_p$) can be obtained by the following formula.

$$T_p = K \times Q/N \quad (1)$$

where Q is mass air flow, N is engine speed, and K is a constant.

Desired injection pulse width ($T_i$) is obtained by correcting the basic injection pulse ($T_p$) with engine operating variables. The following is an example of a formula for computing the desired injection pulse width.

$$T_i = T_p \times (COEF) \times \alpha \times K_a \quad (2)$$

where COEF is a coefficient obtained by adding various correction or compensation coefficients such as coefficients on coolant temperature, full throttle open, engine load, etc., $\alpha$ is a $\lambda$ correcting coefficient (the integral of the feedback signal of an $O_2$-sensor provided in an exhaust passage), and $K_a$ is a correcting coefficient by learning (hereinafter called learning control coefficient). Coefficients, such as coolant temperature coefficient and engine load, are obtained by looking up tables in accordance with sensed informations. The value of the learning control coefficient $K_a$ is obtained from a $K_a$-table in accordance with engine load.

On the other hand, the ignition timing of the engine is decided also by the mass air flow Q. More particularly, if the mass air flow Q increases, the amount of fuel increases and, at the same time, ignition timing is advanced as increasing of the fuel. Accordingly, if a mass air flow meter deteriorates to fail to produce a proper output voltage, the air-fuel ratio of mixture supplied to the engine deviates from a stoichiometry and improper ignition timing is set. For example, if the output voltage increases by the failure of the mass air flow meter, the ignition timing is advanced regardless of engine operating conditions. Such improper advancing of timing will occur the knocking of the engine.

SUMMARY OF THE INVENTION

The object of the present invention is to provide a system which may eliminate problems caused by the failure of a mass air flow meter.

In the system of the present invention, the failure of a sensor is determined by the condition that value of data in a look-up table exceeds a predetermined upper or lower limit value. When the failure is detected, ignition timing is adjusted to compensate the deviation thereof.

According to the present invention, there is provided a system for controlling the amount of fuel to be supplied to an automotive engine by updated data, comprising, a table storing data, an $O_2$-sensor for detecting constituents of exhaust gases of the engine and for producing an output voltage dependent on the concentration of the exhaust gases, and means for updating the data in the table with a value relative to the output voltage. In the system, the updated data is compared with predetermined upper and lower limit values. When the updated data exceeds the upper or lower limit value, the ignition timing of the engine is adjusted.

The other objects and features of this invention will be apparently understood from the following description with reference to the accompanying drawings.

DETAILED DESCRIPTION OF THE PREFERRED EMBODIMENT

Figure 1:
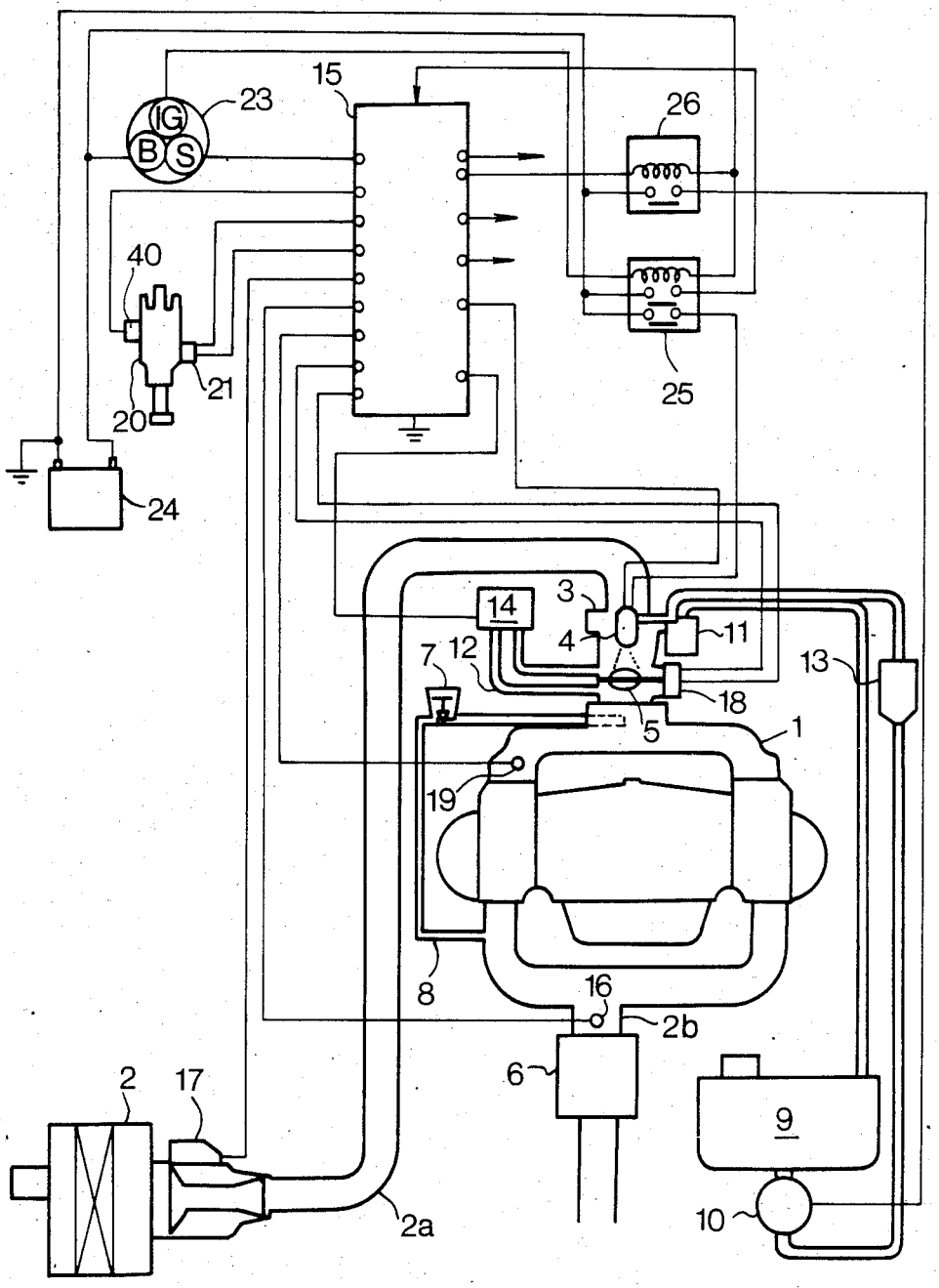
FIG. 1 is a schematic illustration showing a system for controlling the operation of an internal combustion engine for a motor vehicle.

Referring to FIG. 1, an internal combustion engine 1 for a motor vehicle is supplied with air through an air cleaner 2, intake pipe 2*a*, and throttle valve 5 in a throttle body 3, mixing with fuel injected from an injector 4. A three-way catalitic converter 6 and an $O_2$-sensor 16 are provided in an exhaust passage 2*b*. An exhaust gas recirculation (EGR) valve 7 is provided in an EGR passage 8 in a well known manner.

Fuel in a fuel tank 9 is supplied to the injector 4 by a fuel pump 10 through a filter 13 and pressure regulator 11. A solenoid operated valve 14 is provided in a bypass 12 around the throttle valve 5 so as to control engine speed at idling operation. A mass air flow meter 17 is provided on the intake pipe 2*a* and a throttle position sensor 18 is provided on the throttle body 3. A coolant temperature sensor 19 is mounted on the engine. Output signals of the meter 17 and sensors 18 and 19 are applied to a microcomputer 15. The microcomputer 15 is also applied with a crankangle signal from a crankangle sensor 21 mounted on a distributor 20 and a starter signal from a starter switch 23 which operates to turn on-off electric current from a battery 24. The system is further provided with an injector relay 25 and a fuel pump relay 26 for operating the injector 4 and fuel pump 10.

Figure 2:
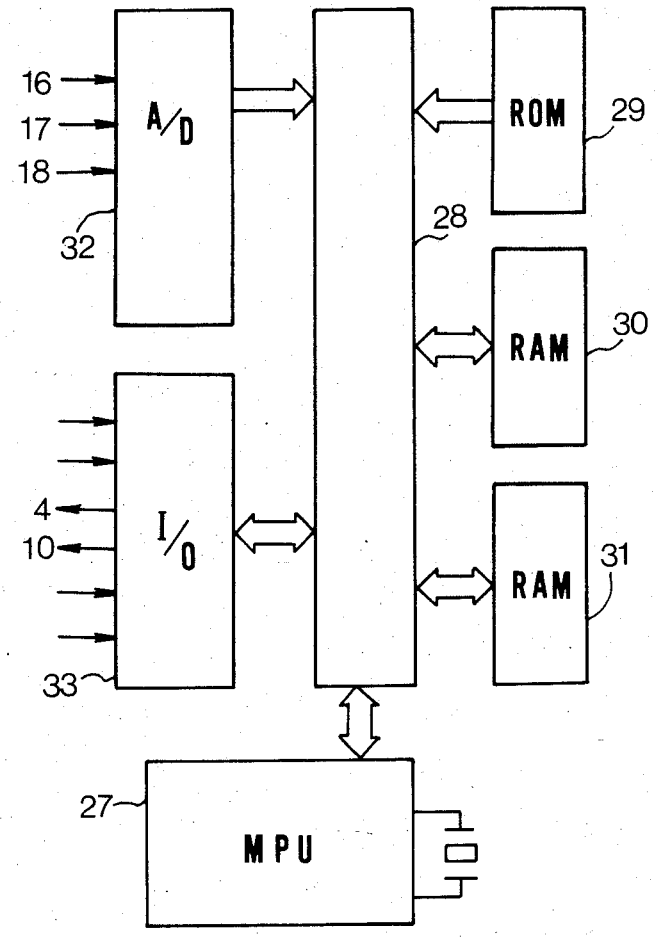
FIG. 2 is a block diagram of a microcomputer system used in a system of the present invention.

Referring to FIG. 2, the microcomputer 15 comprises a microprocessor unit 27, ROM 29, RAM 30, RAM 31 with back-up, A/D converter 32 and I/0 interface 33. Output signals of $O_2$-sensor 16, mass air flow meter 17 and throttle position sensor 18 are converted to digital signals and applied to the microprocessor unit 27 through a bus 28. Other signals are applied to the microprocessor unit 27 through I/O interface 33. The microprocessor manipulates input signals and executes hereinafter described process.

Figure 3A:
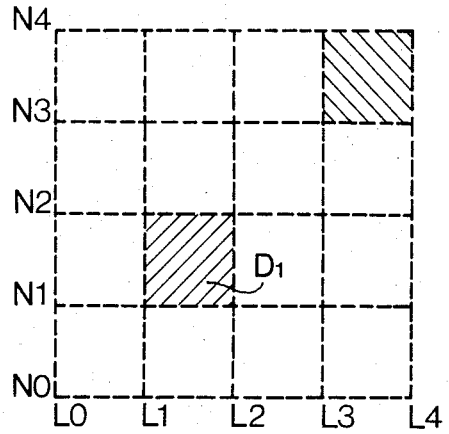
FIG. 3*a* is an illustration showing a matrix for detecting the steady state of engine operation.

The learning control coefficients $K_a$ stored in a $K_a$-table are updated with data calculated during the steady state of engine operation. In the system, the steady state is decided by ranges of engine load and engine speed and continuation of a detected state. FIG. 3*a* shows a matrix for the detection, which comprises, for example sixteen divisions defined by five row lines and five column lines. Magnitudes of engine load are set at five points $L_0$ to $L_4$ on the X axis, and magnitudes of engine speed are set at five points $N_0$ to $N_4$ on the Y axis. Thus, the engine load is divided into four ranges, that is $L_0$-$L_1$, $L_1$-$L_2$, $L_2$- $L_3$, and $L_3$- $L_4$. Similarly, the engine speed is divided into four ranges.

Figure 4A:
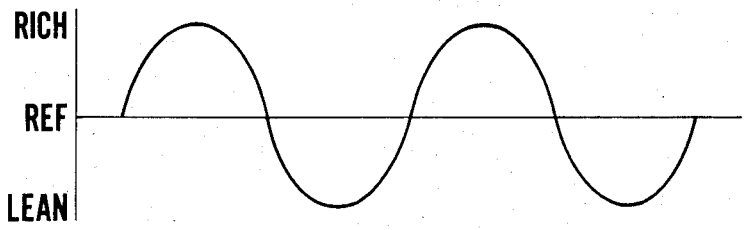
FIG. 4*a* shows the output voltage of an $O_2$-sensor.

On the other hand, the output voltage of the $O_2$-sensor 16 cyclically changes through a reference voltage corresponding to a stoichiometric air-fuel ratio, as shown in FIG. 4*a*. Namely, the voltage changes between high and low voltages corresponding to rich and lean air-fuel mixtures. In the system , when the output voltage (feedback signal) of the $O_2$-sensor continues during three cycles within one of sixteen divisions in the matrix, the engine is assumed to be in steady state.

Figure 3B:
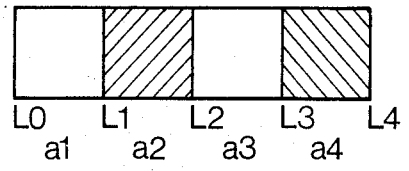
FIG. 3*b* shows a table for learning control coefficients.

FIG. 3*b* shows a $K_a$-table for storing the learning control coefficients $K_a$, which is included in the RAM 31 of FIG. 2. The $K_a$-table is a two-dimensional table and has addresses $a_1$, $a_2$, $a_3$, and $a_4$ which are corresponding to engine load ranges $L_0$- $L_1$, $L_1$- $L_2$, $L_2$- $L_3$, and $L_3$-$L_4$. All of coefficients $K_a$ stored in the $K_a$-table are initially set to the same value, that is the number "1". This is caused by the fact that the fuel supply system is to be designed to provide the most proper amount of fuel without the coefficient $K_a$. However, every automobile can not be manufactured to have a desired function, resulting in same results. Accordingly, the coefficient $K_a$ should be updated by learning at every automobile, when it is actually used.

Figure 4B:
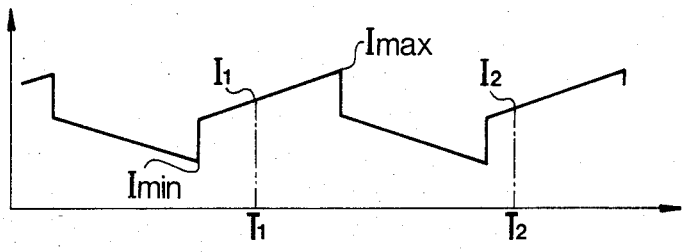
FIG. 4*b* shows the output voltage of an integrator.

Explaining the calculation of the injection pulse width ($T_i$ in formula 2) at starting of the engine, since the temperature of the body of the $O_2$-sensor 16 is low, the output voltage of the $O_2$-sensor is very low. In such a state, the system is adapted to provide "1" as value of correcting coefficient $\alpha$. Thus, the computer calculates the injection pulse width ($T_i$) from mass air flow (Q), engine speed (N), (COEF), $\alpha$ and $K_a$. When the engine is warmed up and the $O_2$-sensor becomes activated, an integral of the output voltage of the $O_2$-sensor at a predetermined time is provided as the value of $\alpha$. More particularly, the computer has a function of an integrator, so that the output voltage of the $O_2$-sensor is integrated. FIG. 4*b* shows the output of the integrator. The system provides values of the integration at a predetermined interval (40 ms). For example, in FIG. 4*b*, integrals $I_1$, $I_2$—at times $T_1$, $T_2$—are provided. Accordingly, the amount of fuel is controlled in accordance with the feedback signal from the $O_2$-sensor, which is represented by integral.

Explaining the learning operation, when steady state of engine operation is detected, the $K_a$-table is updated with a value relative to the feedback signal from the $O_2$-sensor. The first updating is done with an arithmetical average (A) of maximum value and minimum value in one cycle of the integration, for example values of Imax and Imin of FIG. 4*b*. Thereafter, when the value of $\alpha$ is not 1, the $K_a$-table is incremented or decremented with a minimum value ($\Delta A$) which can be obtained in the computer. Namely one bit is added to or subtracted from a BCD code representing the value A of the coefficient $K_a$ which has been rewritten at the first learning.

On the other hand, the system has an electronic ignition timing control device 40 is mounted on distributor 20 (FIG. 1) for controlling the ignition timing dependent on the mass air flow Q.

Figure 7A:
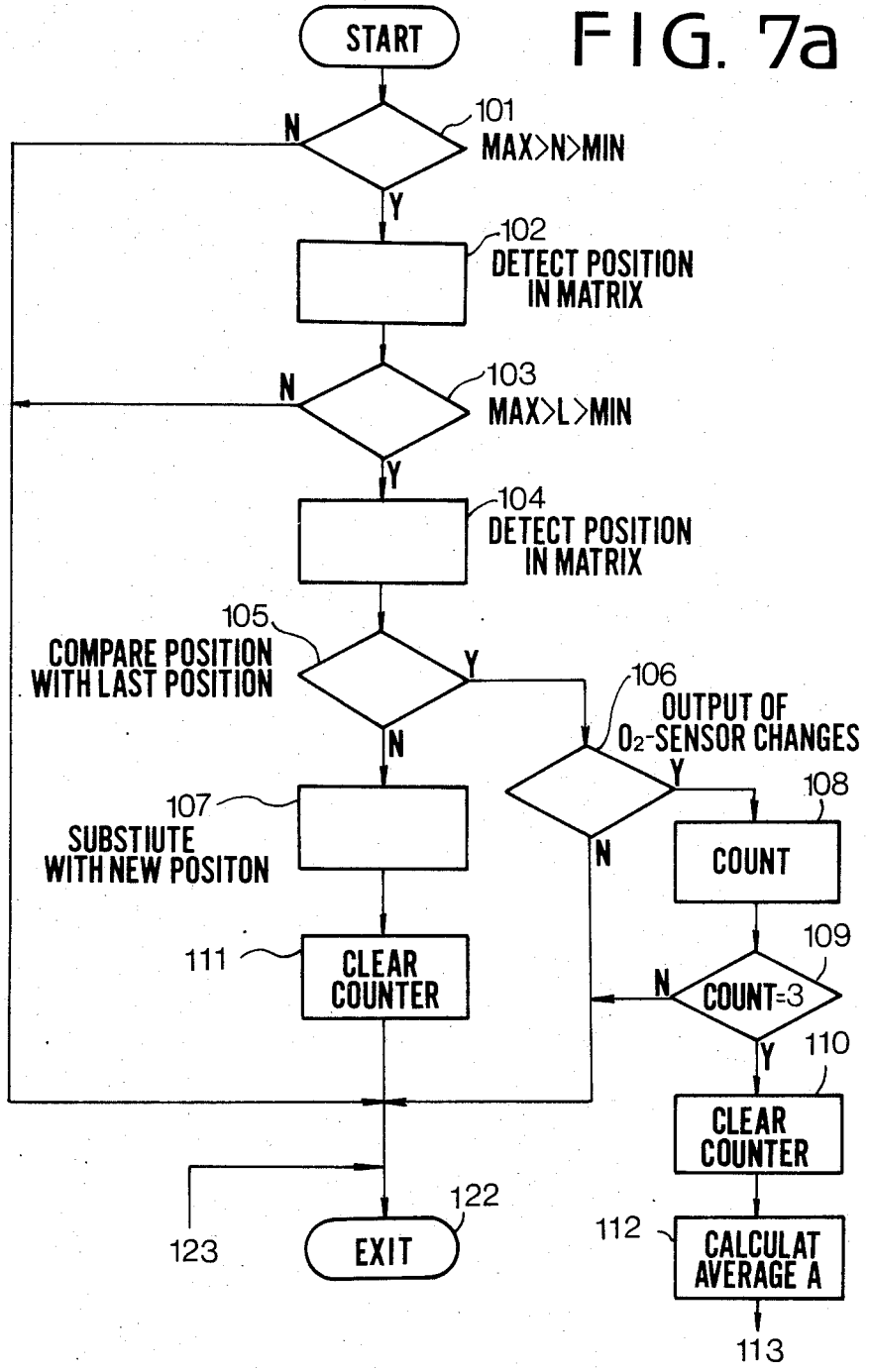
FIGS. 7*a* and 7*b* are flowcharts showing the operation in an embodiment of the present invention.
Figure 7B:
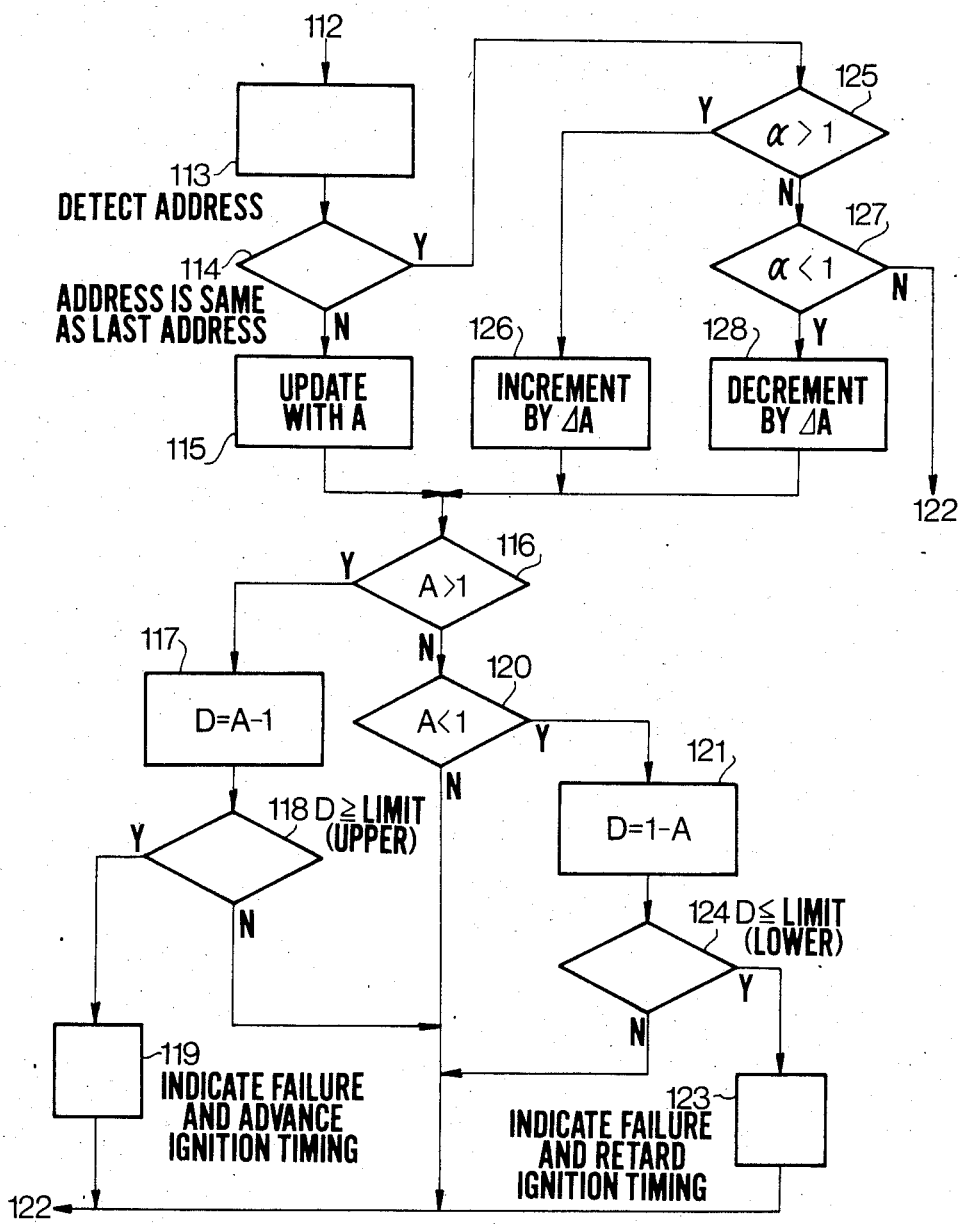

The operation of the system will be described in more detail with reference to FIGS. 7*a* and 7*b*. The learning program is started at a predetermined interval (40 ms). At the first operation of the engine and the first driving of the motor vehicle, engine speed is detected at step 101. If the engine speed is within the range between $N_0$ and $N_4$, the program proceeds to a step 102. If the engine speed is out of the range, the program exits the routine at a step 122. At step 102, the position of the row of the matrix of FIG. 3*a* in which the detected engine speed is included is detected and the position is stored in RAM 30. Thereafter, the program proceeds to a step 103, where engine load is detected. If the engine load is within the range between $L_0$ and $L_4$, the program proceeds to a step 104. If the engine load is out of the range, the program exits the routine. Thereafter, the position of column corresponding the detected engine load is detected in the matrix, and the position is stored in the RAM. Thus, the position of division corresponding to the engine operating condition represented by engine speed and engine load is decided in the matrix, for example, division $D_1$ is decided in FIG. 3*a*. The program advances to a step 105, where the decided position of division is compared with the division which has been detected at the last learning. However, since the learning is first, the comparison can not be performed, and hence the program is terminated passing through steps 107 and 111. At the step 107, the position of division is stored in RAM 30.

At a learning after the first learning, the detected position is compared with the last stored position of division at step 105. If the position of division in the matrix is the same as the last learning, the program proceeds to a step 106, where the output voltage of $O_2$-sensor 16 is detected. If the voltage changes from rich to lean and vice versa, the program goes to a step 108, and if not, the program is terminated. At the step 108, the number of the cycle of the output voltage is counted by a counter. If the counter counts up to, for example three, the program proceeds to a step 110 from a step 109. If the count does not reach three, the program is terminated. At the step 110, the counter is cleared and the program proceeds to a step 112.

On the other hand, if the position of the division is not the same as the last learning, the program proceeds from step 105 to step 107, where the old data of the position is substituted with the new data. At the step 111, the counter which has operated at step 108 in the last learning is cleared.

At step 112, arithmetical average A of maximum and minimum values of the integral of the output voltage of the $O_2$-sensor at the third cycle of the output wave form is calculated and the value A is stored in the RAM. Thereafter, the program proceeds to a step 113, where the address corresponding to the position of division is detected, for example, the address $a_2$ corresponding to the division $D_1$ is detected and the address is stored in the RAM to set a flag. At step 114, the stored address is compared with the last stored address. Since, before the first learning, no address is stored, the program proceeds to a step 115. At step 115, the learning control coefficient $K_a$ in the address of the $K_a$-table of FIG. 3b is entirely updated with the new value A that is the arithmetical average obtained at step 112.

After the updating of the table, the program proceeds to a step 116, where it is determined whether the value A stored in the RAM is greater than "1". If the value A is greater than "1", which means the fact that the value A is increased to compensate lean mixture which is decided by a small value of Q because of failure of the air flow meter. Accordingly, the lean mixture is corrected to proper mixture by the large value of A. However, ignition timing is retarded by a small value of Q. In such a condition, the program proceeds to a step 117 where the difference D between the value A and the desired value "1" is got in order to obtain a value relative to the desired value "1". If the difference D is larger than a predetermined upper limit, which means the failure of the mass air flow meter 17, the program proceeds from a step 118 to a step 119. At the step 119, the failure of the meter is indicated, for example by a lamp, and the ignition timing is advanced to correct the timing. If the difference D is smaller than the upper limit, the program terminates.

If the value A is not greater than "1", it is determined whether the A is smaller than "1", the difference D of the value A and the desired value "1" is obtained at a step 121. If the difference D is smaller than a predetermined lower limit, the program proceeds from a step 122 to a step 123 where the failure of the air flow meter is indicated and ignition timing is retarded.

At a learning after the first updating, if the address detected at the process is the same as the last address, (the flag exists in the address) the program proceeds from step 114 to a step 125, where it is determined whether the value of $\alpha$(the integral of the output of the $O_2$-sensor) at the learning is greater than "1". If the $\alpha$ is greater than "1", the program proceeds to a step 126, where the minimum unit $\Delta A$ (one bit) is added to the learning control coefficient $K_a$ in the corresponding address. If the $\alpha$ is less than "1", the program proceeds to a step 127, where it is determined whether the $\alpha$ is less than "1". If the $\alpha$ is less than "1", the minimum unit $\Delta A$ is subtracted from $K_a$ at a step 128. If the $\alpha$ is not less than "1", which means that the $\alpha$ is "1", the program exits the updating routine. Thus, the updating operation continues until the value of the $\alpha$ becomes "1". The program proceeds from steps 126 and 128 to step 116, and the same programs are performed as the above described programs.

Figure 5:
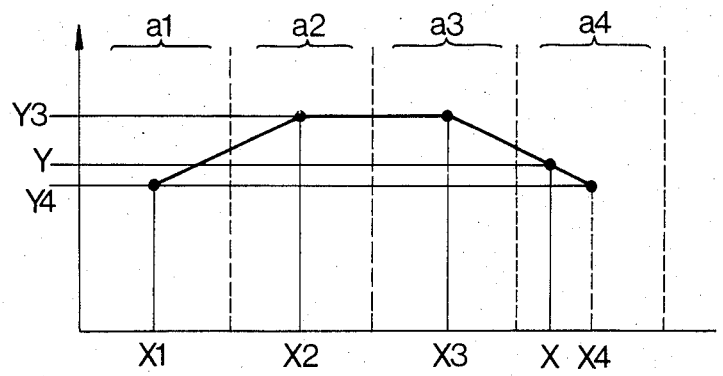
FIG. 5 shows a linear interpolation for reading the table of FIG. 3*b;*

When the injection pulse width ($T_i$) is calculated, the learning control coefficient $K_a$ is read out from the $K_a$-table in accordance with the value of engine load L. However, values of $K_a$ are stored at intervals of loads. FIG. 5 shows an interpolation of the $K_a$-table. At engine loads $X_1$, $X_2$, $X_3$, and $X_4$, updated values $Y_3$ and $Y_4$ (as coefficient K) are stored. When detected engine load does not coincide with the set loads $X_1$ to $X_4$, coefficient $K_a$ is obtained by linear interpolation. For example, value Y of $K_a$ at engine load X is obtained by the following formula.

$$Y=((X-X_3)/(X_4-X_3))\times(Y_4-Y_3)\ Y_3$$

Figure 6A:
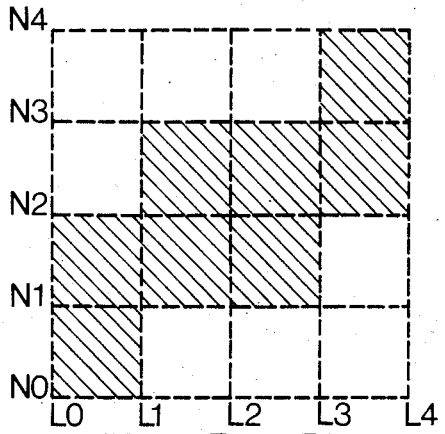
FIGS. 6*a* and 6*b* are illustration for explaining probability of updating.
Figure 6B:
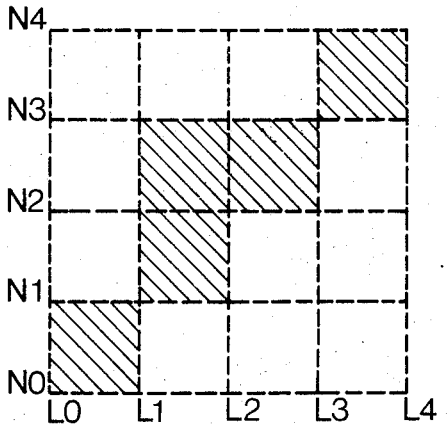

FIG. 6a is a matrix pattern showing the updating probability over 50% and FIG. 6b is a pattern showing the probability over 70% by hatching divisions in the matrix. More particularly, in the hatched range in FIG. 6b, the updating occurs at a probability over 70%. From the figures it will be seen that the updating probability at extreme engine operating steady state, such as the state that at low engine load at high engine speed and at high engine load at low engine speed, is very small. In addition, it is experienced that the difference between values of coefficient $K_a$ in adjacent speed ranges is small. Accordingly, it will be understood that the two-dimensional table, in which a single data is stored at each address, is sufficient for performing the learning control of an engine.

Thus, in accordance with the present invention, the failure of an air flow meter is detected and ignition timing is adjusted to properly maintain engine operation, until the failure is repaired.

While the presently referred embodiment of the present invention has been shown and described, it is to be understood that this disclosure is for the purpose of illustration and that various changes and modifications may be made without departing from the scope of the invention as set forth in the appended claim.

What is claimed is:

1. An ignition timing control system for an automotive engine in which the amount of fuel to be supplied to the engine is controlled by updated data, and the ignition timing is controlled dependent on the amount of the fuel, comprising;

a table storing data;

an $O_2$-sensor for detecting the concentration of exhaust gases of the engine and for producing a feedback signal dependent on the concentration;

first means for updating the data in the table with a value relative to the feedback signal;

second means for comparing the updated data with predetermined upper and lower limits; and third means for adjusting the ignition timing of the engine, when the updated data exceeds the upper or lower limit.

2. The system according to claim 1 wherein the amount of the fuel is controlled dependent on engine operating conditions including mass of air flow.

* * * * *